United States Patent [19]

Minegishi

[11] Patent Number: 4,561,833

[45] Date of Patent: Dec. 31, 1985

[54] FLUID PRESSURE DEVICE

[75] Inventor: Kiyoji Minegishi, Aichi, Japan

[73] Assignee: Sumitomo Heavy Industries, Ltd., Tokyo, Japan

[21] Appl. No.: 482,485

[22] Filed: Apr. 6, 1983

[30] Foreign Application Priority Data

Apr. 7, 1982 [JP] Japan ..... 57-56730
Jan. 25, 1983 [JP] Japan ..... 58-9430

[51] Int. Cl.[4] ..... F01C 1/02; F16H 1/28
[52] U.S. Cl. ..... 418/61 B; 74/804
[58] Field of Search ..... 74/804, 805, 640; 418/61 B

[56] References Cited

U.S. PATENT DOCUMENTS

| | | | |
|---|---|---|---|
| 3,389,618 | 6/1968 | McDermott | 74/804 |
| 3,490,383 | 1/1970 | Parrett | 418/61 B |
| 3,602,615 | 8/1971 | Erwin | 74/804 X |
| 3,784,336 | 1/1974 | Schultz | 418/61 |
| 3,846,051 | 11/1974 | McDermott | 418/61 B |
| 3,849,034 | 11/1974 | Ohnesorge | 418/61 B |
| 3,910,733 | 10/1975 | Grove | 74/804 X |
| 4,264,288 | 4/1981 | Wusthof et al. | 418/61 B |
| 4,282,777 | 8/1981 | Ryffel et al. | 74/804 |

FOREIGN PATENT DOCUMENTS

| | | | |
|---|---|---|---|
| 1528997 | 8/1971 | Fed. Rep. of Germany . | |
| 2015897 | 10/1971 | Fed. Rep. of Germany | 418/61 B |

*Primary Examiner*—Leslie A. Braun
*Assistant Examiner*—Stephen B. Andrews
*Attorney, Agent, or Firm*—Armstrong, Nikaido, Marmelstein & Kubovcik

[57] ABSTRACT

A fluid pressure device of the inner gearing type comprising an outer gear having circumferentially arranged external teeth, and an inner gear eccentrically disposed relative to the outer gear and having circumferentially arranged internal teeth in meshing engagement with the external teeth of the outer gear, so that one of the gears makes an orbital movement around the axis of the other gear while rotating around its own axis. The inner gear is mounted in a stationary ring member in inner gearing relation so as to be able to make orbital movement relative to the stationary ring. Alternatively, the outer gear is mounted in an inner gearing relation around a rotary member which is adapted to rotate in unison with the input/output shaft of the device so as to be able to make an orbital movement around the rotary member. The inner gearing relation is realized by a plurality of cylindrical axially extending pins circumferentially disposed on one of the associated members and a plurality of dents having an arcuate profile in meshing engagement with each pin and circumferentially formed on the other of the associated members, the number of the dents being equal to that of the pins. According to this arrangement, it is possible to attain a highly efficient transmission of only the rotation, while cancelling the orbital movement, between the input/output shaft and the inner gear or outer gear which makes both of the orbital movement and rotation simultaneously within the fluid pressure device.

8 Claims, 14 Drawing Figures

FLUID PRESSURE DEVICE

BACKGROUND OF THE INVENTION

The present invention relates to a fluid pressure device of the inner gearing type comprising an outer gear having circumferentially arranged external teeth and an inner gear eccentrically disposed relative to the outer gear and having circumferentially arranged internal teeth in meshing engagement with the external teeth of the outer gear, wherein one of the gears which acts as a rotor rotates around its own axis while making an orbital movement around the axis of the other gear which works as a stator so that expandable and contractable fluid working chambers are formed between the meshing teeth of the gears. The present invention relates more particularly to a torque transmission mechanism between the rotor and the output shaft or input shaft associated with the rotor in a fluid pressure device of the kind stated above.

In the fluid pressure device of the kind described, only the rotation of the rotor around the axis thereof is taken out while cancelling the orbital movement to drive the output shaft. Alternatively, the rotation of the input shaft is transmitted to the rotor to cause the orbital movement and rotation of the rotor. In a conventional fluid pressure device of the kind described, the transmission of torque between the rotor and the output or input shaft is made by a mechanism which incorporates a drive shaft inclined with respect to the axes of the rotor and the output or input shaft and splined at both ends thereof to the rotor and the shaft.

FIG. 1 illustrates a fluid pressure device having a torque transmission mechanism of the above-explained type, used as a hydraulic motor. This hydraulic motor is generally composed of three sections: namely, an output mechanism section a', displacement chamber section (fluid working chamber section) b' and a valve mechanism section c'. The transmission of torque between the output mechanism section a' and the displacement chamber section b' is made through a drive 1', while the transmission of torque between the displacement chamber section b' and the valve mechanism section c' is made by means of a valve switching drive 2'. To this end, each of the drive 1' and the valve switching drive 2' is provided with splines at both ends thereof. The output section a' is composed of an output shaft 4' having internal splines in engagement with splines of the drive 1', housing 5' and bearings 6' supporting the output shaft 4' and is arranged to transmit the output to a driven machine while bearing the external load. The displacement chamber produces an orbital movement of an outer gear 3' simultaneously with the rotation of the outer gear 3' around the axis thereof. The drive 1' transmits only the rotation of the outer gear 3' to the output shaft 4' while cancelling the orbital movement.

On the other hand, the valve mechanism section c' has a valve 7' having internal splines in engagement with splines of the valve switching drive 2', valve plate 9' which is fixed to a ring 8' and arranged to switch the passage of the pressurized oil in cooperation with the valve 7' and a valve housing 10'. The valve switching drive 2' transmits only the rotation of the outer gear 3' to the valve 7' to rotate the latter while cancelling the orbital movement. The function of the valve mechanism section c' is to distribute the pressurized oil from the pump to the displacement chambers 11' while collecting the oil returning from the latter.

As will be seen from FIG. 2, in the displacement chamber section b', the teeth of an inner gear 12' have an arcuate profile constituted by rollers 13' while the teeth of the outer gear 3', gearing with the teeth of the inner gear 12', have a trochoidal (epitrochoid parallel curve) profile. The number of the teeth of the outer gear 3' is smaller by one than the number of the teeth of the inner gear 12'. The axis 14' of the inner gear and the axis 15' of the outer gear are arranged at an eccentricity e with respect to each other. The outer gear 3' and the inner gear 12' define displacement chambers 11' by the points of contact between these gears. The number of the displacement chambers 11' is equal to the number of the teeth of the inner gear 12' which is 7 in the example shown in FIG. 2. In operation, pressurized oil is supplied to the displacement chambers 11' through the valve mechanism section c' so that the displacement chambers 11' repeat expansion and contraction to cause an orbitary movement of the outer gear 3' around the axis 14' of the inner gear simultaneously with the rotation of the outer gear 3' around its own axis 15', thereby to convert the pressure energy of the pressurized oil into torque. This torque is transmitted from the internal splines of the outer gear 3' to the internal splines of the output shaft 4' through the drive 1' so that only the rotation of outer gear 3' is utilized for driving an external load while the orbital movement is cancelled.

The known hydraulic motor of the kind described encounters the following problems due to eccentric orbital movement of the outer gear 3' with respect to the output shaft 4'.

(1) It is necessary to employ a drive 1' provided at both ends with external splines, as well as internal splines in the outer gear 3' and the output shaft 4'.

(2) The meshing between the splines of interconnected members does not meet the theoretical condition of meshing from the view point of mechanics of a gear, since relative eccentric movement is involved between the interconnected members. Therefore, the contact between the splines takes place only over a limited axial length thereof so that the effective contact length of the spline cannot be increased even by an increase of the axial length of the spline.

(3) In order to minimize the influence of the eccentricity, it is necessary to employ a certain minimum distance between the internal splines of the outer gear 3' and the internal splines of the output shaft 4' or the internal splines of the valve 7'.

(4) The diameter of the drive 1' must be selected to be sufficiently small as compared with the diameter of the output shaft, in order that it can make an oscillatory orbital movement within the output shaft 4'.

This type of hydraulic motor advantageously permits the provision of a series of devices having various supply rates only by changing the axial breadth of the displacement chamber section b' without requiring the change of other parts. However, when the supply rate is increased by increasing the breadth of the displacement chamber section b', the motor is obliged to operate only at low pressure because there is a limit in the transmission of the output torque between the splines of the drive 1' and the output shaft 4'.

In order to obviate the above-described problems, it has been proposed to eliminate the drive 1' by employing another means of torque transmission between the outer gear and the output shaft. Fluid pressure devices employing such substitutive torque transmission means are disclosed in U.S. Pat. No. 3,389,618 and West German Pat. No. 2,844,844. In one of the hydraulic motors proposed in such patents, the outer gear is directly coupled to the output shaft to make it rotatable in unison with the output shaft, while the inner gear is disposed for an orbital movement within a stationary ring member which is coaxial with the output shaft. In another known hydraulic motor, the inner gear is stationarily disposed coaxially with the output shaft, while the outer gear is disposed for orbital movement around a rotary member which is fixed to the output shaft. In order to realize the orbital movement of the inner gear or the outer gear, an inner gearing condition is maintained between the inner gear and the stationary ring or between the outer gear and the rotary member through a plurality of articulated holes formed therebetween and extending axially with each hole being formed partly in the confronting peripheries of the both members, and a plurality of cylindrically shaped rollers loosely disposed respectively in the holes.

The torque transmission through the holes and rollers, however, still suffers from the following disadvantages.

(1) The teeth profile does not perfectly meet the requirement in view of mechanics so that theoretical meshing condition cannot be achieved.

(2) Each hole consists of two arcuate portions so that the tooth height is small and the number of teeth held in any one meshing state at a time is impractically small.

(3) Generation of noise and vibration, as well as deterioration in the performance and life, is inevitable due to the disadvantages (2) stated above.

SUMMARY OF THE INVENTION

Accordingly, it is a primary object of the invention to improve the torque transmission mechanism proposed in the aforementioned patents to realize a theoretical meshing state which well meets the condition for meshing from the view point of mechanics, thereby to provide a small-sized fluid pressure device having a torque transmission mechanism capable of transmitting large torque with small size and operable with a distinguished performance for a long period of time.

To this end, according to the invention, there is provided a fluid pressure device of the inner gearing type comprising a first member having circumferentially arranged external teeth, a second member eccentrically disposed relative to the first member and having circumferentially arranged internal teeth in meshing engagement with the external teeth of the first member and an axis adapted to make orbital movement about the axis of the first member, and either a stationary ring member coaxially disposed with the first member and mounting therein the second member in inner meshing relationship therewith for orbital movement of the second member about the axis of the ring member or a rotatable member coaxially disposed with the second member and mounting therearound the first member in inner meshing relationship therewith for orbital movement of the first member about the axis of the rotatable member, wherein the inner meshing relationship between the two associated members is provided with a plurality of cylindrical pins circumferentially disposed on one of the associated members to extend in the axial direction of the members and a plurality of indentations circumferentially disposed on the other of the associated members and equal in member to the pins, each said indentations having a arcuate profile in meshing engagement with the pin, the diameter of the pitch circle of the pins being equal to that of the indentations, and the following relationship being established between the inner diameter $d_2$ of the dent and the outer diameter $d_1$ of the pin:

$$d_2 = d_1 + 2l.$$

where l is the eccentric distance between the first and the second members.

The above and other objects, features and advantages of the invention will become clear from the following description of the preferred embodiments taken in conjunction with the accompanying drawings.

DESCRIPTION OF THE PREFERRED EMBODIMENTS

Figure 1:
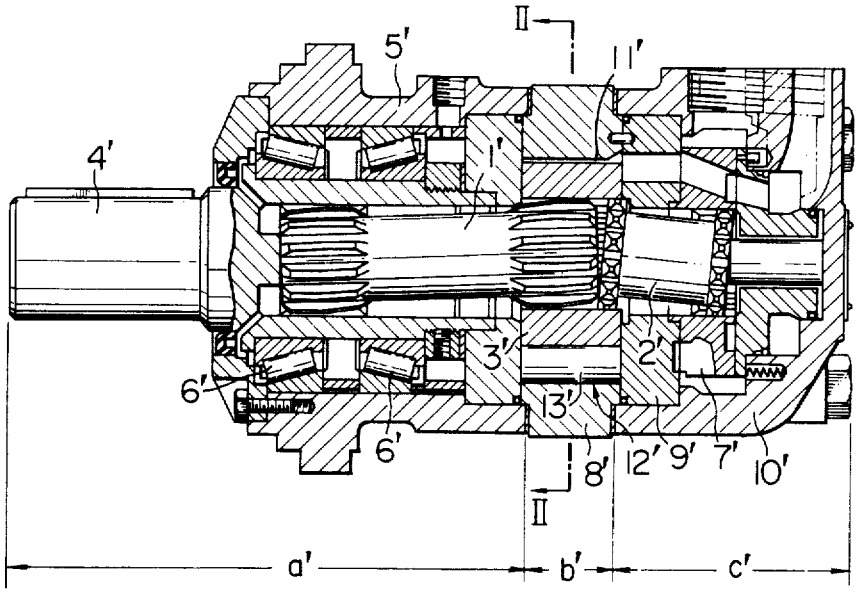
FIG. 1 PRIOR ART
FIG. 1 is a longitudinal sectional view of a hydraulic motor having a conventional torque transmission mechanism.
Figure 2:
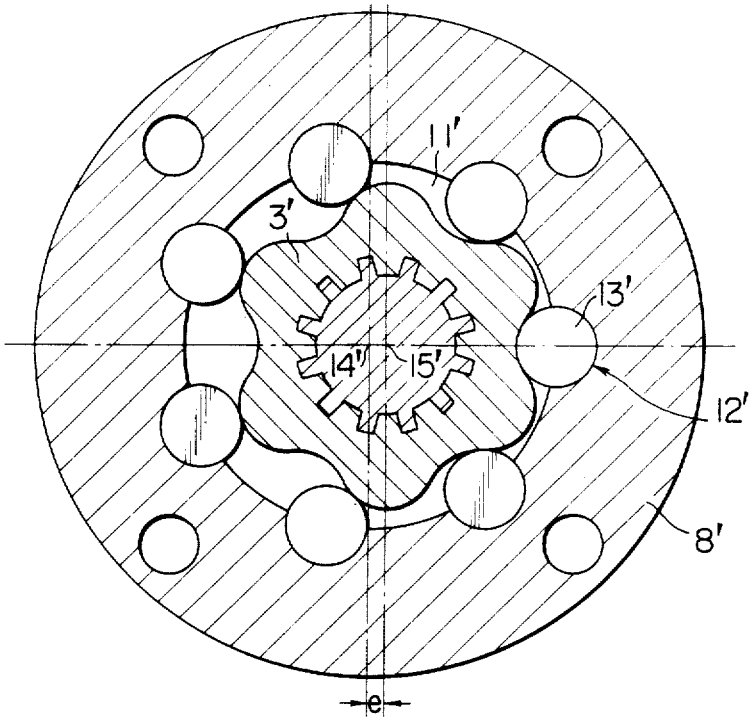
FIG. 2 PRIOR ART
FIG. 2 is an enlarged sectional view taken along the line II—II of FIG. 1.
Figure 3:
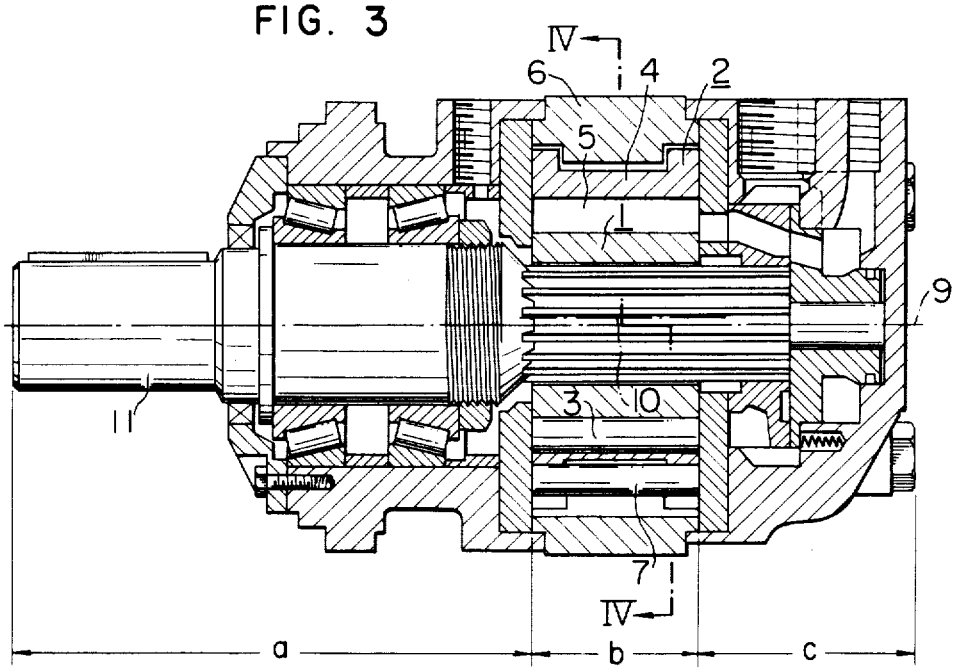
FIG. 3 is a longitudinal sectional view of a hydraulic motor in accordance with a first embodiment of the invention.
Figure 4:
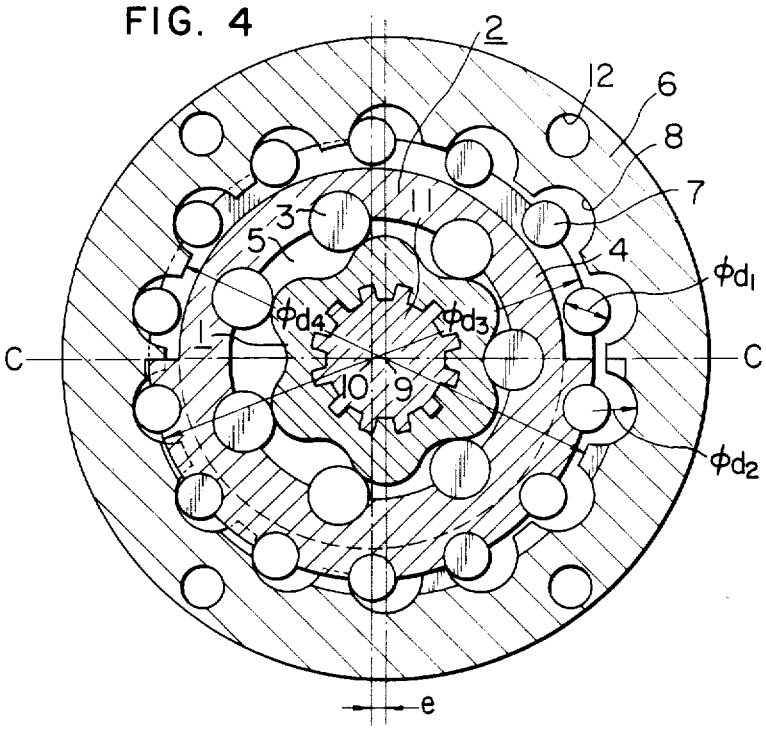
FIG. 4 is an enlarged sectional view taken along the line IV—IV of FIG. 3.
Figure 5:
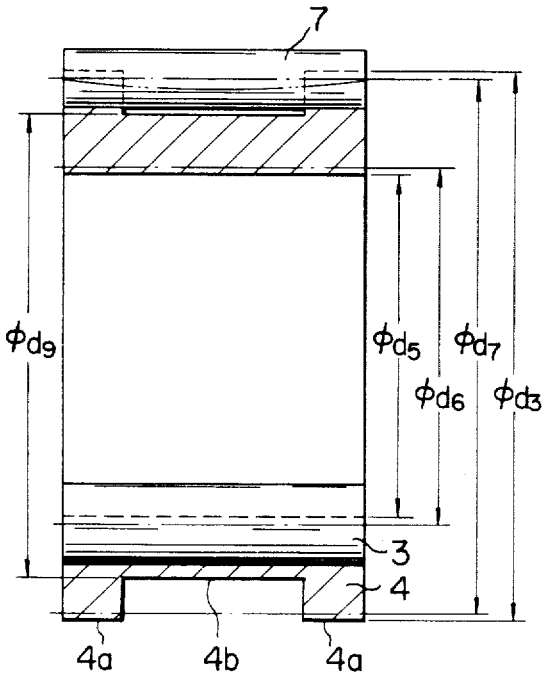
FIGS. 5 and 6 are longitudinal sectional views of an inner gear and a prior art stationary ring member of the first embodiment, respectively.

A hydraulic motor in accordance with a first embodiment of the invention will be described hereinunder with specific reference to FIGS. 3 to 6. An outer gear 1 has teeth having a trochoidal (epitrochoid parallel curve) profile and an inner gear 2 making inner gearing with the outer gear 1 has teeth of arcuate tooth profile constituted by an intermediate ring 4 and rollers 3 held by the ring 4, as in the case of a known device. The inside diameter $d_5$ of the intermediate ring 4 is smaller than the pitch circle diameter $d_6$ of the rollers 3 (see FIG. 5), so that the rollers 3 are prevented from coming off from the ring 4. Displacement chambers 5 are defined between the outer gear 1 and the inner gear 2 as in the case of the conventional device. The inner gear 2 is disposed for orbital movement in an outer stationary ring 6. Mediation pins 7 are disposed on the outer peripheral surface of the intermediate ring 4 of the gear 2 at a constant circumferential pitch, so that external teeth of arcuate tooth profile are formed by these pins 7. As will be seen from FIG. 5, the outer peripheral surface of the intermediate ring 4 has a stepped form constituted by mediation pin holding portions 4a of a larger diameter formed at both axial end portions and a clearing portion 4b of a smaller diameter at the intermediate portion. The outside diameter $d_3$ of the mediation pin holding portions 4a is smaller than the addendum circle diameter $d_4$ of the stationary ring 6 but is greater than the pitch circle diameter $d_7$ of the mediation pins 7. Therefore, each mediation pin 7 is embraced over an angle greater than 180° by the corresponding bearing surfaces formed in the mediation pin holding portions 4a so that it is held securely. On the other hand, arcuate indentations 8 of a number corresponding to the number of the mediation pins 7 are formed in the inner peripheral surface of the stationary ring 6, for meshing engagement with the mediation pins 7. The stationary ring 6 has a stepped inner peripheral surface constituted by clearing portions 6a of a larger diameter at both axial ends and an intermediate internal teeth portion 6b of a smaller diameter. The inside diameter $d_8$ of the stationary ring clearing portion 6a is determined in relation to the outside diameter $d_3$ of the mediation pin holding portion 4a of the intermediate ring 4 to meet the condition of:

$$d_8 \leqq d_3 + 2d$$

where, e represents the eccentricity.

On the other hand, the outside diameter $d_9$ of the intermediate ring clearing portion 4b is determined in relation to the inside diameter $d_4$ of the internal teeth portion 6b of the stationary ring in such a manner as to meet the condition of:

$$d_9 \leqq d_4 - 2e$$

The center of the pitch circle of the mediation pins 7 concides with the center of the pitch circle of the rollers 3 of the inner gear 2, while the center of the pitch circle of the indentations 8 of the stationary ring 6 coincides with the center 9 of the outer gear 1 and, in the illustrated case, also with the axis of the output shaft 11. The diameter of the pitch circle of the indentations 8 is equal to the diameter of the pitch circle of the mediation pins 7. The inside diameter $d_2$ of the arcuate profile of the dent 8 is determined in relation to the outside diameter $d_1$ of the mediation pin 7 so as to satisfy the condition of:

$$d_2 = d_1 + 2e$$

where, e represents the eccentricity of the intermediate ring 4 from the stationary ring 6.

Thus, the mediation pins 7 and the dents 8 in combination form a constant velocity gearing mechanism of an equal pitch circle diameter and an equal number of teeth. In the Figures, a reference numeral 12 designates bolt holes in the stationary ring 6.

Figure 6:
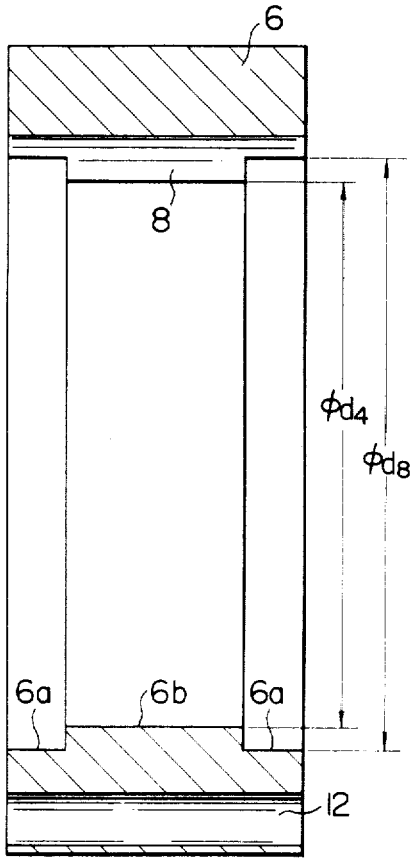
Figure 7:
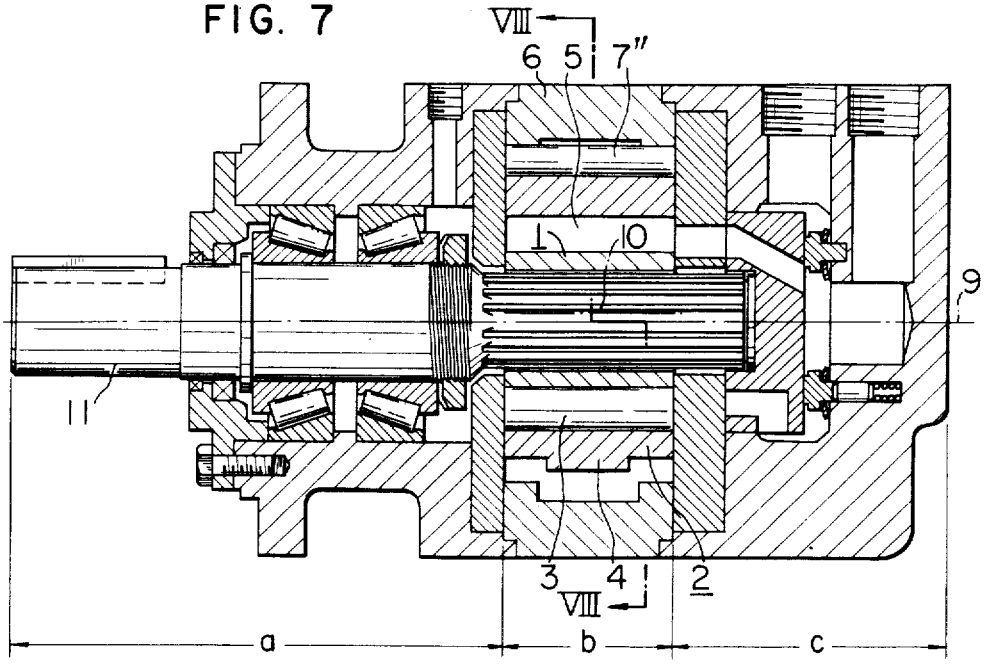
FIG. 7 is a longitudinal sectional view of a hydraulic motor in accordance with a second embodiment of the invention.
Figure 8:
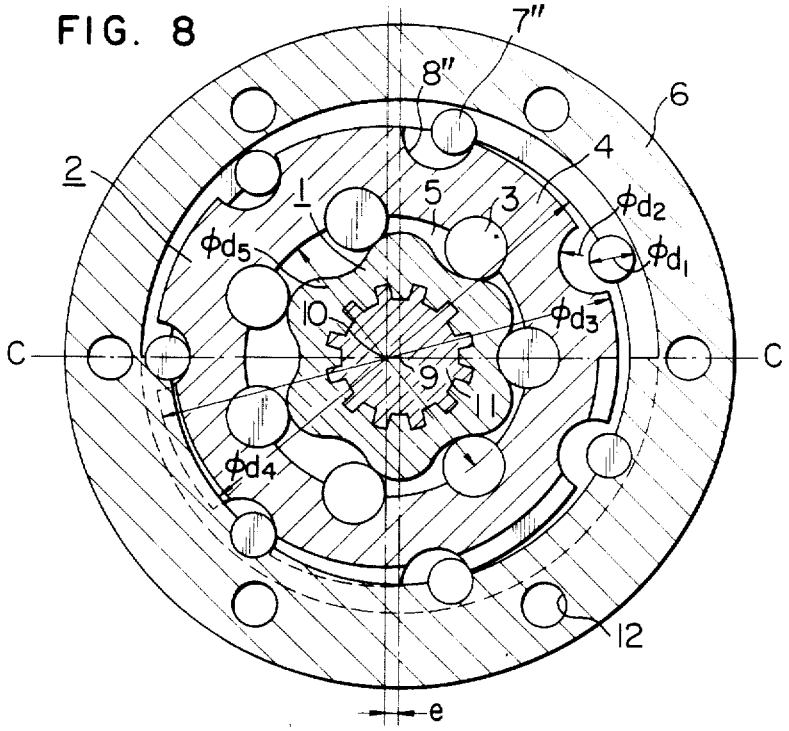
FIG. 8 is an enlarged sectional view taken along the line VIII—VIII of FIG. 7.
Figure 9:
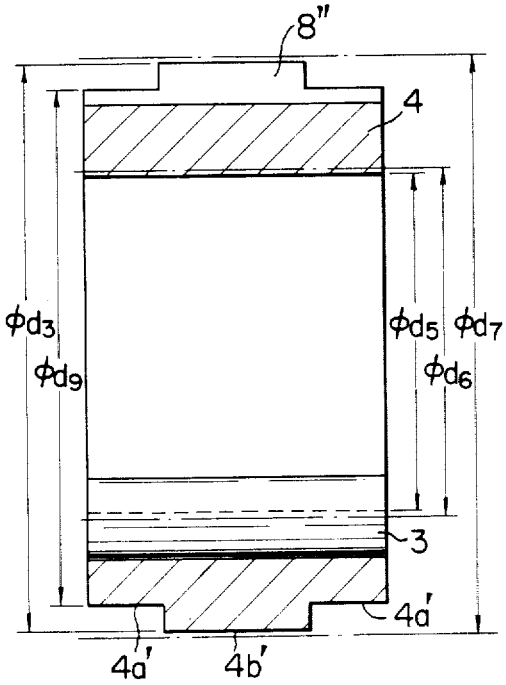
FIGS. 9 and 10 are longitudinal sectional views of an inner ring and a stationary ring member of the second embodiment, respectively.
Figure 10:
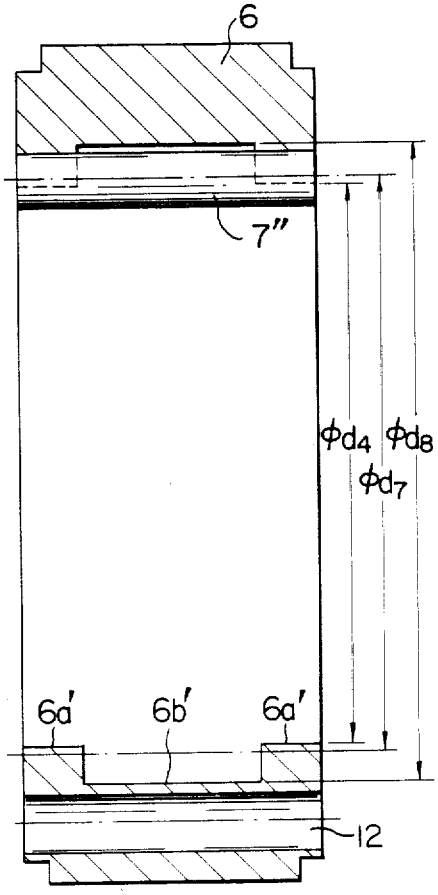

According to this arrangement, the intermediate ring 4 makes an orbital movement within the stationary ring 6 around the center of the latter at a radius which is equal to the eccentricity e. In addition, when the mediation pins are brought into engagement with the indentations 8, the intermediate portions of the mediation pins 7 are allowed to get deeper into the internal tooth portion 6b of the stationary ring, so that it is possible to obtain a sufficiently large length of meshing. FIG. 6 illustrates the tooth bottom of the indentation 8 extended into the stationary ring clearing portion 6a. It may be, however, possible to arrange such that the tooth bottom is located at the radially inner side of the stationary ring clearing portion 6a and thus the indentation 8 is formed only in the internal tooth portion 6b of the stationary ring 6.

The hydraulic motor of this embodiment can be assembled by the following procedure. First of all, the outer gear 1 and the inner gear 2 are assembled together, and the assembly is inserted in the axial direction into the stationary ring 6 with the axis 9 of the assembly aligned with the axis of the stationary ring 6. During the insertion, the mediation pins 7 are put out of the intermediate ring 4 of the inner gear. Then, the angular position of the intermediate ring 4 with respect to the stationary ring 6 is adjusted until the pin supporting holes of the intermediate ring 4 are aligned with the addendums of the stationary ring 6, i.e. to the position where the intermediate ring 4 is rotated by about a half pitch in either direction from the position shown in FIG. 4. The above-mentioned insertion is then conducted. Thereafter, the intermediate ring 4 is rotated to the position where the mediation pin supporting holes align with the indentation 8 of the stationary ring, i.e. substantially to the position shown in FIG. 4, and the mediation pins 7 are inserted in the axial direction to complete the assembling. After the insertion of the mediation pin 7, these pins 7 are received by corresponding indentation 8 in the stationary ring and thus the rotation of the intermediate ring 4 is confined within a limited range so that the constituents are held in the assembled state. The assembling, however, may be made also by a process in which, in advance to the assembling of the outer gear 1 and the inner gear 2 together, the mediation pins 7 are attached to the outer peripheral surface of the intermediate ring 4 and only the inner gear 2 is inserted into the stationary ring 6 while maintaining the same coaxially with the latter and, finally, the outer gear 1 is inserted into the inner gear 2 after offsetting the inner gear.

As in the case of the known hydraulic motor, the hydraulic motor of this embodiment is composed of an output mechanism section a, a displacement chamber section b, and a valve mechanism section c. The displacement chambers 5 make expansion and contraction as pressurized oil is supplied into the displacement chambers 5 through the valve mechanism section c. In consequence, the inner gear 2 having the intermediate ring 4 makes an eccentric motion which consists only of an orbital movement around the axis 9 of the outer gear 1, because the meshing between the mediation pins 7 and the indentation 8 prevents the inner gear 2 from rotating around its own axis. At this time, the mediation pins 7 roll along the indentation 8 and are elastically deformed during the rolling movement by the load generated between the pins 7 and the indentation 8. Since the orbital movement of the intermediate ring 4 conveniently cancels the orbital movement of the outer gear 1 around the axis 9 of the output shaft 11, only the rotation of the outer gear 1 about its own axis is transmitted to the output shaft 11. It will be understood that, in this operation, the outer gear 1 makes an eccentric motion consisting of an orbital movement with respect to the intermediate ring 4 around the axis 10 of the latter.

Thus, the described embodiment offers the following advantages.

(1) Since the output shaft 11 can be splined directly to the outer gear 1, it is possible to eliminate the drive and the valve switching drive which are indispensable in the conventional device.

(2) Theoretical meshing state satisfying the meshing condition from view point of mechanics is realized between the outer gear 1 and the inner gear 2, as well as between the mediation pins 7 and the indentation 8. Therefore, the contact stresses applied to the teeth are maintained constant even if the teeth widths are increased to increase the oil supply rate, provided that the oil is supplied at a constant pressure.

(3) Each mediation pin 7 is supported at its both ends by the mediation pin supporting portions 4*a* on the intermediate ring 4, but the intermediate portion of the pin 7 has no support, so that the pin 7 is allowed to be flexed sufficiently to increase the number of the meshing teeth advantageously.

(4) Imagine here a line C—C which passes the axis 9 of the outer gear 1 and the axis 10 of the inner gear 2. The portion of the displacement chambers 5 located at one side of the line C—C is maintained at higher pressure while the portion at the other side is maintained at lower pressure. In consequence, the intermediate ring 4 is elastically deformed by the force generated by the hydraulic pressure, so that the pitch circle of the mediation pins 7 is deviated from the theoretical one to cause some error. This error, however, is absorbed by elastic or resilient deformation of the medium pins 7 by the load, i.e. the hydraulic pressure.

(5) The indentations and the mediation pins 7 in combination constitute a constant velocity inner gearing mechanism constituted by arcuate teeth. The number of teeth held in meshing condition at a time can be increased because the intermediate ring 4 and the stationary ring 6 have stepped peripheral surfaces to permit an increase of the height of the teeth of the internal tooth portion 6*b* constituted by the indentations 8 of the stationary ring.

(6) For the reason as described above, the torque transmission mechanism is freed from the limitation of the output torque imposed by the presence of the drive in the conventional hydraulic motor, so that the output torque can be increased while reducing the size and weight of the hydraulic motor.

(7) The theoretical meshing achieved between associated teeth, in combination with the large number of the meshing couples of the mediation pins 7 and indentations 8, ensures a smooth operation and longer life of the hydraulic motor. In addition, the load applied to each couple of the mediation pin and indentation is decreased owing to the large number of couples taking part in the bearing of the load at one time.

(8) It is possible to reduce the production cost because the necessity for the machining of splines is reduced remarkably.

A second embodiment of the hydraulic motor in accordance with the invention will be described with specific reference to FIGS. 7 to 10. In this embodiment, mediation pins 7'' are arranged on the inner peripheral surface of the stationary ring 6 while the arcuate indentations 8'' for meshing engagement with the pins 7'' are formed in the outer peripheral surface of the intermediate ring 4. Other portions are materially identical to those of the first embodiment, and the same reference numerals are used to denote such identical portions as the first embodiment. The intermediate ring 4 is provided with a stepped outer peripheral surface constituted by clearing portions 4*a'* of a smaller diameter at both axial ends and an external toothed portion 4'*b* of a larger diameter at the intermediate portion thereof.

On the other hand, the stationary ring 6 is provided with a stepped inner peripheral surface constituted by mediation pin supporting portions 6'*a* of a smaller diameter at both axial ends and a clearing portion 6'*b* of a larger diameter at the intermediate portion thereof. The mediation pins 7'' and the indentations 8'' in combination constitute a constant speed inner gearing mechanism. The inside diameter $d_4$ of the mediation pin supporting portions 6'*a* is smaller than the diameter $d_7$ of the pitch circle of the mediation pins 7'' which is equal to the pitch circle diameter of the indentations 8'', but is greater than the outside diameter $d_3$ of the external toothed portion 4'*b* of the intermediate ring. The diameter $d_8$ of the stationary ring clearing portion 6'*b* is determined in relation to the outside diameter $d_3$ of the external toothed portion 4'*b* of the intermediate ring so as to satisfy the condition of:

$$d_8 \geqq d_3 + 2e$$

where, e represents the eccentricity.

On the other hand, the outside diameter $d_9$ of the intermediate ring clearing portion 4'*a* is determined in relation to the inside diameter $d_4$ of the mediation pin supporting portion 6'*a* so as to meet the condition of:

$$d_9 \leqq d_4 - 2e$$

The center of the pitch circle of the mediation pins 7'' on the stationary ring 6 coincides with the center 9 of the outer gear 1 and also with the center of the output shaft 11.

The inside diameter $d_2$ of the indentation 8'' is determined in relation to the outside diameter $d_1$ of the mediation pin 7'' to meet the following condition as in the case of the first embodiment:

$$d_2 = d_1 + 2e$$

where, e represents the eccentricity of the intermediate ring 4 from the stationary ring 6.

Thus, the mediation pins 7'' and the indentations 8'' in combination constitute a constant speed internal gearing mechanism.

The way of assembling, operation and the advantage of this embodiment are materially identical to those of the first embodiment.

Figure 11:
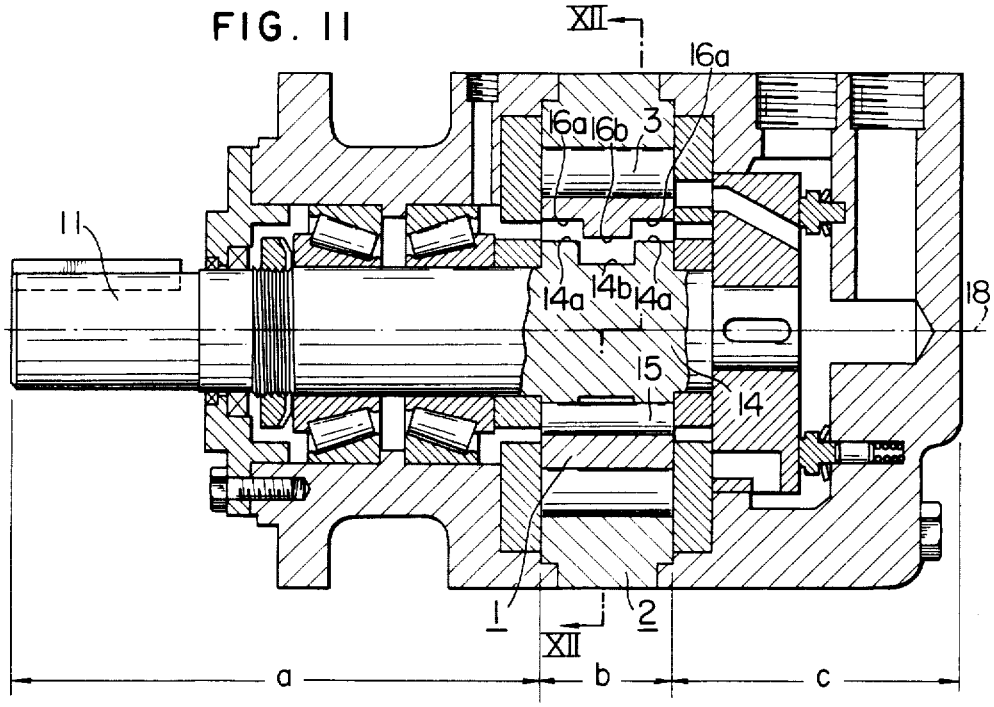
FIG. 11 is a longitudinal sectional view of a hydraulic motor in accordance with a third embodiment of the invention.
Figure 12:
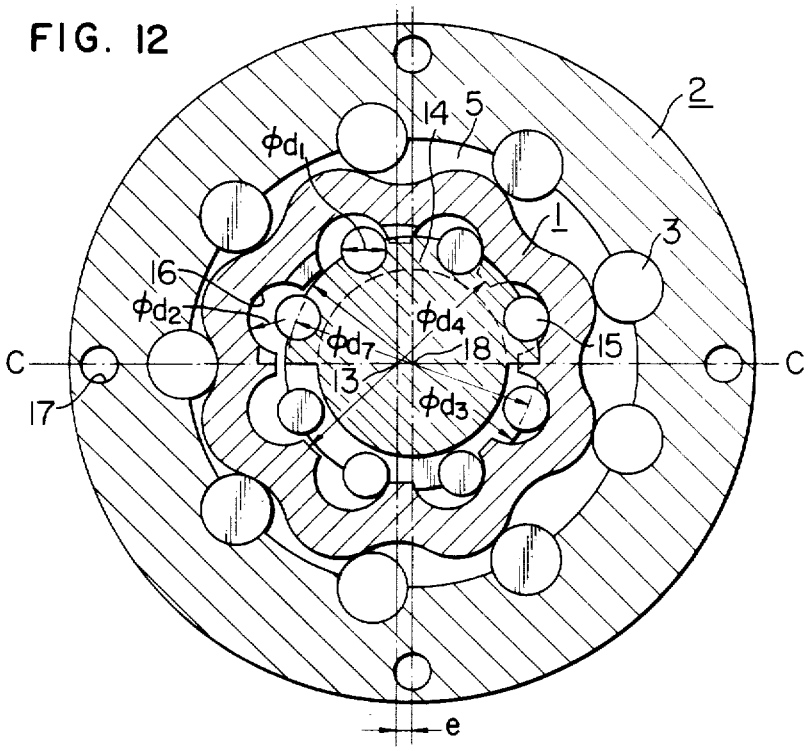
FIG. 12 is an enlarged sectional view taken along the line XII—XII of FIG. 11.

FIGS. 11 and 12 in combination show a third embodiment of the hydraulic motor in accordance with the invention. This embodiment is distinguished from the first and second embodiments by the following features. Namely, in this embodiment, the inner gear 2 is arranged coaxially with the output shaft 11 and held stationarily, and the outer gear 1 is provided with a central bore. The output shaft 11 is provided with a rotary member 14 which is formed integrally therewith as an increased diameter portion thereof and received by the central bore of the outer gear 1 through an inner gearing mechanism placed therebetween in such a manner as to permit the outer gear 1 to make an orbital movement while rotating around its own axis within the inner gear 2. The construction of the mechanism for imparting hydraulic motoring action, however, is materially identical to those in the first and second embodiments. The identical parts, therefore, are designated at same reference numerals. In this embodiment, the inner gearing mechanism for transmitting the torque is composed of mediation pins 15 arranged on the outer peripheral surface of the rotary member 14 at a constant circumferential pitch and arcuate indentations 16 for meshing engagement with the mediation pins 15, formed in the inner peripheral surface defining the central bore of the outer gear 1. The number of the indentations 16 is equal to the number of the mediation pins 15. The rotary member 14 is provided with a stepped outer peripheral surface constituted by mediation pin supporting portions 14*a* of a large diameter at both axial ends and a clearing portion 14*b* of a smaller diameter at the intermediate portion thereof. On the other hand, the outer gear 1 is provided with a stepped inner peripheral surface constituted by clearing portions of a greater diameter at both axial ends and an internal toothed portion 16*b* at the intermediate portion thereof. The outside diameter $d_3$ of the mediation pin supporting portions 14*a* of the rotary member 14 is selected to be smaller than the diameter $d_4$ of adendum circle of the arcuate indentations 16 formed in the internal toothed portion 16*b* of the outer gear 1 but is greater than the pitch circle diameter $d_7$ of the mediation pins 15, so that the mediation pins 15 held at their both ends by the mediation pin supporting portions 14*a* are prevented from coming off from the rotary member 14 in the radial direction. The inside diameter $d_8$ of the clearing portion 16*a* of the outer gear 1 is determined with respect to the outside diameter $d_3$ of the mediation pin supporting portions 14*a* to meet the condition of:

$$d_8 \geqq d_3 + 2e$$

where, e represents the eccentricity.

Similarly, the outside diameter $d_9$ of the clearing portion 14*b* of the rotary member 14 is determined in relation to the inside diameter $d_4$ of the internal toothed portion 16*b* of the outer gear 1 so as to meet the condition of:

$$d_9 \leqq d_4 - 2d$$

The diameter of the pitch circle of the indentation 16 is equal to that of the pitch circle of the mediation pins 15. In addition, the inside diameter $d_2$ of the arc of each indentation 16 is determined in relation to the outside diameter $d_1$ of the mediation pin 15 so as to meet the condition of:

$$d_2 = d_1 + 2e$$

where, e represents the eccentricity of the outer gear 1 from the inner gear 2.

Thus, the mediation pins 15 and the indentations 16 in combination constitute a constant speed gearing mechanism having equal diameter of pitch circles and equal number of teeth.

In operation, as in the case of the first and second embodiment, the displacement chambers 5 are made to expand and contract as they are supplied with pressurized oil through the valve mechanism section c, so that the outer gear 1 meshing with the inner gear 2 makes an orbital movement around the axis 18 of the inner gear 2 while rotating around its own axis 13. In this operation, since the mediation pins 15 make meshing engagement with the indentations 16 of the outer gear 1 while rolling along the inner surfaces of the indentations 16, the outer gear 1 makes only an orbital movement with respect to the rotary member 14 at a radius which is equal to the eccentricity e, so that only the rotation of the outer gear 1 is transmitted to the rotary member 14. In consequence, the output shaft 11 is rotated at a speed equal to the rotation of the outer gear 1. The confronting stepped peripheral surfaces of the rotary member 14 and the outer gear 1 permit the intermediate portions of the mediation pins 15 to gets deeper into the indentation formed in the internal toothed portion 16*b* of the outer gear 1, as explained before in connection with the first embodiment, so that there is an increase in the meshing length and, hence, the number of teeth taking part in the meshing at a time, thereby to increase the torque transmission efficiency. It will be clear to those skilled in the art that this third embodiment of the invention offers the same advantages as those presented by the first embodiment.

Figure 13:
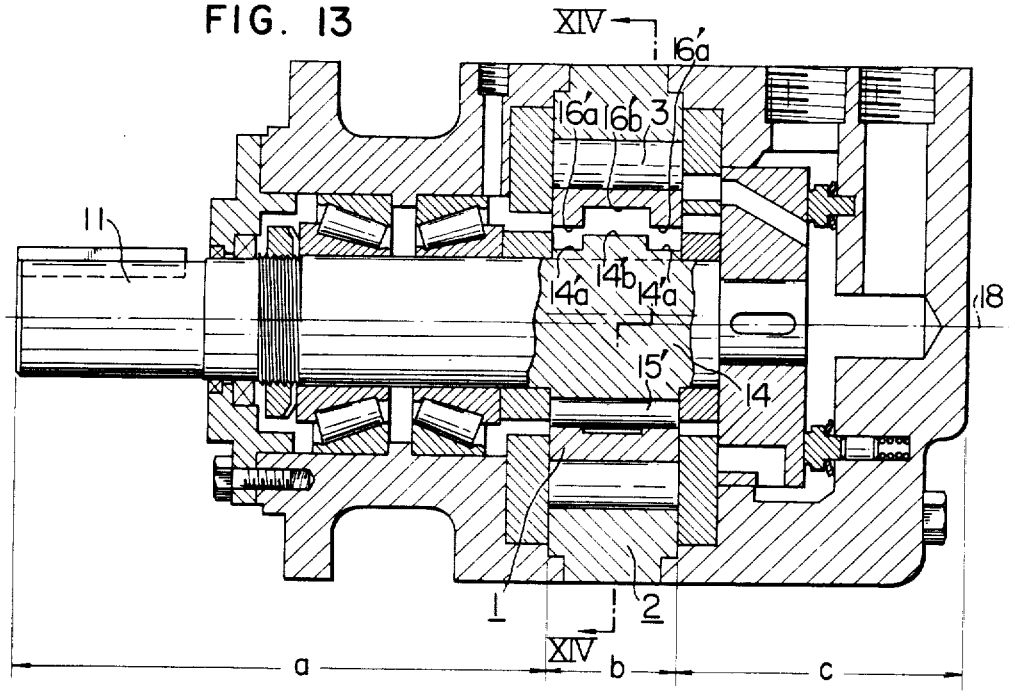
FIG. 13 is a longitudinal sectional view of a hydraulic motor in accordance with a fourth embodiment of the invention.
Figure 14:
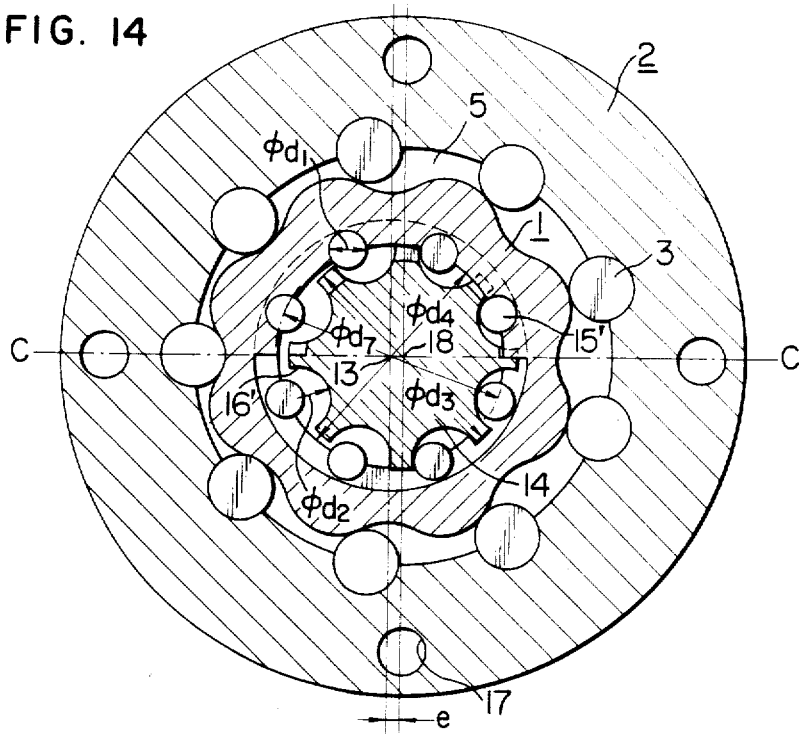
FIG. 14 is an enlarged sectional view taken along the line VIV-XIV of FIG. 13.

Finally, a fourth embodiment of the hydraulic motor in accordance with invention will be described hereinunder with specific reference to FIGS. 13 and 14. In this embodiment, mediation pins 15' are disposed on the inner peripheral surface of the outer gear 1 while arcuate indentations 16' for meshing engagement with these mediation pins 15' are formed in the outer peripheral surface of the rotary member 14. Other portions are materially identical to those of the third embodiment, and the same reference numerals are used to denote same parts as those of the third embodiment. Namely, while in the third embodiment the mediation pins are disposed at the inner side of the arcuate indentations for meshing engagement therewith, the fourth embodiment is modified such that the mediation pins are disposed at the outer side of the meshing indentations. Thus, the relationship of the fourth embodiment to the third embodiment is just the same as the relationship of the second embodiment to the first embodiment. Therefore, the inside diameter $d_4$ of the mediation pin supporting portions 16'*a* of the outer gear 1 is smaller than the diameter $d_7$ of the pitch circle of the mediation pins 15' and, hence, the diameter of the pitch circle of the indentations 16' but is greater than the outside diameter $d_3$ of the external toothed portion 14'*b* of the rotary member 14. At the same time, the inside diameter $d_8$ of the clearing portion 16'*b* of the outer gear 1 is determined in relation to the outside diameter $d_3$ of the external toothed portion 14'*b* of the rotary member 14 so as to satisfy the condition of:

$$d_8 \geqq d_3 + 2e$$

where, e represents the eccentricity. On the other hand, the outside diameter $d_9$ of the clearing portion 14'*a* of the rotary member 14 is determined in relation to the inside diameter $d_4$ of the mediation pin supporting portions 16'*a* of the outer gear 1 such that the following condition is met:

$$d_9 \leqq d_4 - 2e.$$

The other portions of the arrangement and advantages of the fourth embodiment will be readily understood by a reference to the descriptions of the first to third embodiments.

Although the invention has been described through specific reference to hydraulic motors, it will be clear to those skilled in the art that the invention can be applied equally to hydraulic pumps, and the same advantages are offered also by such application.

What is claimed is:

1. A fluid pressure device of the inner gearing type comprising a first member having an axis and circumferentially arranged external teeth, a second member eccentrically disposed relative to said first member and having circumferentially arranged internal teeth of said first member and an axis adapted to make orbital movement about the axis of said first member, and a stationary ring third member coaxially disposed with said first member and mounting therein for inner meshing relationship with said second member for orbital movement of said second member about the axis of said third member, wherein said inner meshing relationship between said second and third members is provided with a plurality of cylindrical pins circumferentially disposed on one of said second and third members to extend in the axial direction of said members and a plurality of indentations circumferentially disposed on the other of said second and third members and equal in number to said pins, each said indentation having an arcuate profile in meshing engagement with said pin, the diameter of the pitch circle of said pins being equal to that of said indentations, and the following relationship being established between the inner diameter $d_2$ of said indentation and the outer diameter $d_1$ of said pin:

$$d_2 = d_1 + 2e,$$

where, e is the eccentric distance between the first and the second members, said one of said second and third members being provided on its peripheral surface confronting that of the other of said second and third members with an annular recess at the axially intermediate portion thereof and annular protrusions at the both axial ends thereof for holding both ends of said pins, while said the other of said second and third members is provided on its peripheral surface thereof confronting that of said one of said second and third members with an annular protrusion at the axially intermediate portion thereof adapted to be received by said recess in said one of said second and third members and annular recesses at the both axial ends thereof for receiving said annular protrusions of said one of said second and third members.

2. A fluid pressure device according to claim 1, wherein the inside diameter $d_4$ of said annular protrusion and the inside diameter $d_8$ of said annular recess of the radially outer one of said second and third members, and the outside diameter $d_3$ of said annular protrusion and the outside diameter $d_9$ of said annular recess of the radially inner one of said second and third members are determined to meet the following conditions:

$$d_4 > d_3,\ d_8 \geqq d_3 + 2e, \text{ and } d_9 \leqq d_4 - 2e.$$

3. A fluid pressure device according to claim 1 or 2, wherein said second member is constituted by an intermediate ring which carrys said pins on the outer peripheral surface thereof, while said dents are formed in the inner peripheral surface of said stationary ring member, the outside diameter $d_3$ of said annular protrusion of said second member and the diameter $d_7$ of the pitch circle of said pins being determined to meet the condition of:

$$d_3 > d_7.$$

4. A fluid pressure device according to claim 1 or 2, wherein said second member is constituted by an intermediate ring having said dents formed in the outer peripheral surface thereof, while said pins are held on the inner peripheral surface of said stationary ring member, the inside diameter $d_4$ of said annular protrusion of said stationary ring member and the diameter $d_7$ of the pitch circle of said pins being determined to meet the condition of $d_4 < d_7$.

5. A fluid pressure device of the inner gearing type comprising a first member having an axis and circumferentially arranged external teeth, a second member eccentrically disposed relative to said first member and having circumferentially arranged internal teeth in meshing engagement with said external teeth of said first member and an axis adapted to make orbital movement about the axis of said first member, and a rotatable third member coaxially disposed with said second member and mounting around said first member in inner meshing relationship therewith for orbital movement about the axis of said first member, wherein said inner meshing relationship between said first and third members is provided with a plurality of cylindrical pins circumferentially disposed on one of said first and third members to extend in the axial direction of said members and a plurality of indentations circumferentially disposed on the other of said first and third members and equal in number to said pins, each said indentation having arcuate profile in meshing engagement with said pin, the diameter of the pitch circle of said pins being equal to that of said indentations, and the following relationship being established between the inner diameter $d_2$ of said indentation and the outer $$d_2 = d_1 + 2e$$

where, e is the eccentric distance between the first and the second members, said one of said first and third members is provided on its peripheral surface confronting that of the other of said first and third members with an annular recess at the axially intermediate portion thereof and annular protrusions at the both axial ends thereof for holding both ends of said pins, while said the other of said first and third members is provided on its peripheral surface thereof confronting that of said one of said first and third members with an annular protrusion at the axially intermediate portion thereof adapted to be received by said recess in said one of said first and third members and annular recesses at the both axial ends thereof for receiving said annular protrusions of said one of said first and third members.

6. A fluid pressure device according to claim 5, wherein the inside diameter $d_4$ of said annular protrusion and the inside diameter $d_8$ of said annular recess of the radially outer one of said first and third members, and the outside diameter $d_3$ of said annular protrusion and the outside diameter $d_9$ of said annular recess of the radially inner one of said first and third members are determined to meet the following conditions:

$$d_4 > d_3,\ d_8 \geqq d_3 + 2e, \text{ and } d_9 \leqq d_4 - 2e.$$

7. A fluid pressure device according to claim 5 or 6, where in said second member is stationarily fixed, while said first member is formed with a coaxial central bore receiving therein said rotary member having a cylindrical form, said pins being held on the outer periphery of said rotary member while said indentations are formed in the inner peripheral surface of said bore of said first member, the outside diameter $d_3$ of the annular protrusion of said rotatable third member and the diameter $d_7$ of the pitch circle of said pins being determined to meet the condition of $d_3 > d_7$.

8. A fluid pressure device according to claim 5 or 6, wherein said second member is fixed stationarily, while said first member is formed with a coaxial central bore receiving therein said rotary member having a cylindrical form, said pins being held on the inner peripheral surface of said bore of said first member while said indentations are formed in the outer peripheral surface of said rotatable third member, the inside diameter $d_4$ of said annular protrusion of said first member and the diameter $d_7$ of pitch circle of said pins being determined to meet the condition of $d_4 < d_7$.

* * * * *